US005873808A

United States Patent [19]

Piller et al.

[11] Patent Number: 5,873,808

[45] Date of Patent: Feb. 23, 1999

[54] FOLDING BLADE SHAFT OF A FOLDING CYLINDER

[75] Inventors: Rainer Piller, Affing; Reinhard Mayr, Augsburg; Erwin Bradl, Zahling; Herbert Lutz, Augsburg, all of Germany

[73] Assignee: Man Roland Drückmaschinen AG, Offenbach, Germany

[21] Appl. No.: 899,625

[22] Filed: Jul. 23, 1997

[30] Foreign Application Priority Data

Jul. 23, 1996 [DE] Germany ..... 196 29 674.9

[51] Int. Cl.[6] ..... B65H 45/16

[52] U.S. Cl. ..... 493/424; 493/425; 493/426

[58] Field of Search ..... 493/424, 425, 493/426, 427, 428, 429, 430, 431, 432, 433, 434

[56] References Cited

U.S. PATENT DOCUMENTS

| | | | |
|---|---|---|---|
| 3,727,909 | 4/1973 | Greiner . | |
| 5,096,175 | 3/1992 | Lange . | |
| 5,201,701 | 4/1993 | Roettger . | |
| 5,507,714 | 4/1996 | Furuta | 493/424 |
| 5,637,072 | 6/1997 | Michaelis | 493/424 |

FOREIGN PATENT DOCUMENTS

| | | |
|---|---|---|
| 184 051 | 6/1986 | European Pat. Off. . |
| 858 472 | 1/1961 | United Kingdom . |
| 1 001 538 | 8/1965 | United Kingdom . |
| 2 289 742 | 11/1995 | United Kingdom . |
| WO 86/02418 | 4/1986 | WIPO . |

*Primary Examiner*—Joseph J. Hail, III
*Assistant Examiner*—Christopher W. Day
*Attorney, Agent, or Firm*—Cohen, Pontani, Lieberman & Pavane

[57] ABSTRACT

In a folding blade shaft of a folding cylinder of a drum folding apparatus, the drive shaft and spindle are connected so that the slanting of these parts does not cause any damage to the machine. To this end, the drive shaft and the spindle are connected to each other via a disk packet and centered by a radial rocker bearing.

4 Claims, 2 Drawing Sheets

FOLDING BLADE SHAFT OF A FOLDING CYLINDER

BACKGROUND OF THE INVENTION

1. Field of the Invention

The invention relates to a folding blade shaft of a folding cylinder of a drum folding apparatus.

2. Description of the Prior Art

In folding cylinders, the folding blade shaft, which is composed of a drive shaft and a spindle, is mounted with these parts in the driving gears. When the folding blade is stopped, twisting of the driving gears can ensue, which leads to slanting of the folding blade shaft. This slanting stresses and damages the mounting of the drive shaft and, in some cases, the feather key connection of the coupling flanges that connect the drive shaft and the spindle.

SUMMARY OF THE INVENTION

Accordingly, it is an object of the present invention to provide, in a folding blade shaft, an economical coupling for the drive shaft and the spindle that allows these parts to slant.

Pursuant to this object, and others which will become apparent hereafter, one aspect of the present invention resides in a folding blade shaft comprising a drive shaft, a spindle, a disk packet arranged to connect the drive shaft and the spindle so as to permit a tilting movement of the drive shaft and the spindle, the disk packet being screwed to the spindle, and a radial rocker bearing arranged between the drive shaft and the spindle so as to center the drive shaft and the spindle.

The disk packet, thanks to its stiffness against twisting, transmits the torque from the drive shaft to the spindle without any turning error. This creates a precondition for good folding accuracy. Furthermore, the disk packet fixes the spindle in place in the axial direction and, as a flexible connecting part, permits a tilting movement between the drive shaft and the spindle. A slant of the spindle therefore causes no damage to the bearings or other machine elements. The radial rocker bearing ensures that the spindle is in a central position relative to the drive shaft and in this way contributes to good folding accuracy as well. The drive shaft and the spindle are accordingly connected by means of simple, economical elements.

In another embodiment of the invention both the drive shaft and the spindle each have a flange mounted thereon. The disk packet being screwed alternately to the flanges. Each flange is provided with a recess across from the fastening point so as to permit the tilting movement to take place.

In yet another embodiment of the invention an annular clamping element is provided for mounting the respective flange to the end of the drive shaft and the spindle.

In yet a further embodiment of the invention the radial rocker bearing includes an outer ring arranged in a face bore of the drive shaft and an inner ring arranged on the journal of the spindle.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
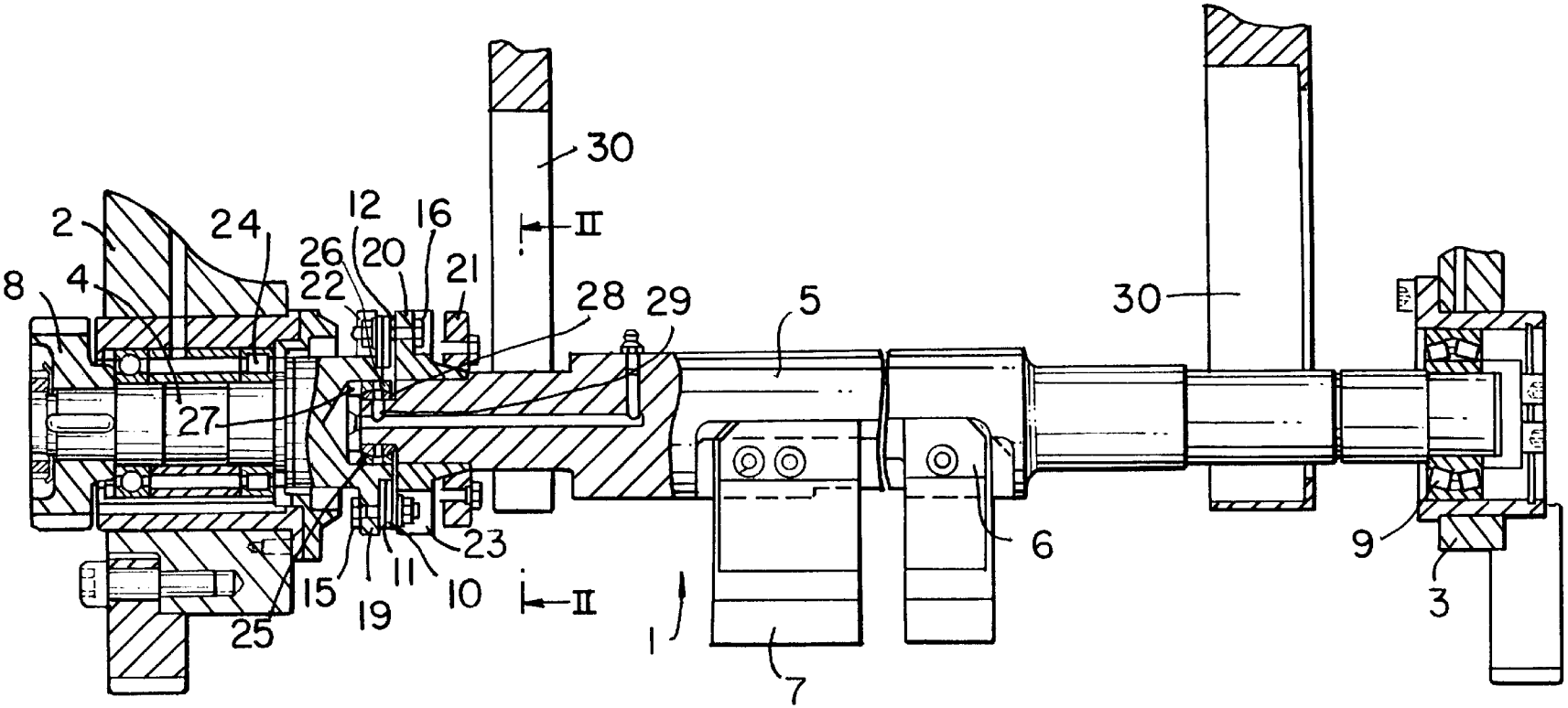
FIG. 1 shows a segment of a folding cylinder with a folding blade shaft, in partial section.

FIG. 1 shows the folding blade shaft 1 of a folding cylinder 30, e.g., a collecting and folding cylinder, of a drum folding apparatus. Only the face plates that limit this folding cylinder 30 laterally are shown. The folding blade shaft 1 comprises a drive shaft 4 and a spindle 5. A folding blade 7 is attached to a flat surface of the spindle 5 by a strip 6.

Figure 2:
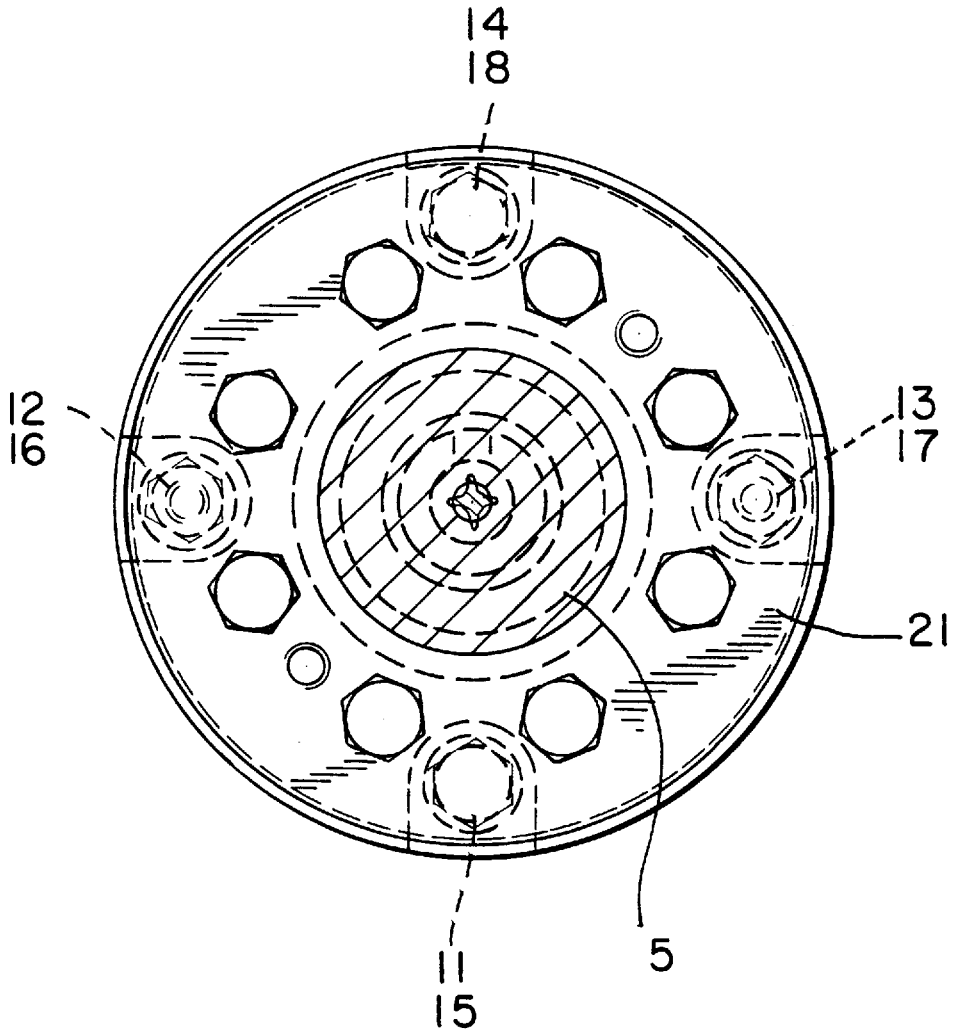
FIG. 2 is a Section along the line II—II in FIG. 1.

The drive shaft 4, which carries a pinion 8 for its drive, is mounted in a driving gear 2. The spindle 5 is mounted in a driving gear 3 by means of a swivel-joint roller bearing 9. In terms of drive, the drive shaft 4 and the spindle 5 are connected to each other via a disk packet 10. Advantageously, this can be a disk packet such as that used, for example, in the ARPEX couplings of the Flender Company. The disk packet 10 consists of multiple leaf spring disks, which are held together with multiple bushes 11 to 14, similar to a hollow rivet connection. The disk packet 10 is screwed to the drive shaft 4 and the spindle 5 by screws 15 to 18 (FIG. 2), which are inserted through the bushes 11 to 14. The drive shaft 4 and the spindle 5 each carry a flange 19, 20. In the illustrated embodiment, the drive shaft 4 ends with the flange 19, while the flange 20 is mounted on the spindle 5 by an annular clamping element 21, belonging to a flange bush. The flange 19, 20 can also be embodied differently, for example, using flange bushes with a feather key connection. The disk packet 10 is screwed alternately to both of the flanges 19, 20. It is screwed to the flange 19 by the screw 15 (and its associated nut), which is inserted through the bush 11. On the adjacent bushes 12, 13 (FIG. 2), the disk packet 10 is then screwed by means of the screws 16, 17 to the flange 20 (the bush 12 and screw 16 are shown rotated into the plane of the drawing in FIG. 1). On the bush 14, the disk packet 10 is in turn attached by means of the screw 18 to the flange 19. Each flange 19, 20 has a recess 22, 23, which is located across from a fastening point. Thus, the flange 20 has recess a 23 in the region of the bush 11, which is screwed to the flange 19, while the flange 19 has a recess 22 in the region of the bush 12, which is screwed to the flange 20. These recesses can also be created by embodying the flange 19, 20 in the shape of a rod or star, depending on the number of the fastening points placed upon it.

In the event that the spindle 5 is slanted (tilted) relative to the drive shaft 4, the disk packet 10 deforms elastically. Thanks to the recesses 22, 23, the fastening elements (15 to 18) can thereby enter into the region of the respective opposite flange 19, 20. In the illustrated embodiment, slants of up to 0.4 degrees are possible. Thanks to the elastic connection between the spindle 5 and the drive shaft 4, strong tilting stress is avoided on the cylindrical roller bearing 24 of the drive shaft 4. The swivel-joint roller bearing 9 at the other end of the spindle 5 is designed to absorb slants of this type.

A radial rocker bearing 25 ensures that the end of the spindle 5 is centered relative to the drive shaft 4, even when the spindle 5 slants. An outer ring 26 of the radial rocker bearing 25 is arranged in a face bore 27 of the drive shaft 4. An inner ring 28 of the radial rocker bearing 25 is arranged on a journal 29 of the spindle 5. In the reverse of this, the outer ring 26 can be arranged in the spindle 5 and the inner ring 28 can be arranged on the drive shaft 4. The radial rocker bearing 25 also absorbs the radial forces from the folding process.

The invention is not limited by the embodiments described above which are presented as examples only but can be modified in various ways within the scope of protection defined by the appended patent claims.

We claim:

1. A folding blade shaft, connected to a folding blade, of a folding cylinder of a drum folding apparatus, comprising:

a drive shaft;

a spindle;

a flexible disk packet arranged to connect the drive shaft and the spindle so as to fix the spindle in place relative to an axial direction and permit a tilting movement between the drive shaft and the spindle to prevent damage to respective machine elements when movement of the folding blade and associated folding blade shaft is stopped, the disk packet being screwed to the spindle; and a radial rocker bearing arranged between the drive shaft and the spindle so as to center the drive shaft relative to the spindle to ensure good folding accuracy.

2. A folding blade shaft as defined in claim 1, and further comprising a first flange mounted on the drive shaft and a second flange mounted on the spindle, the disk packet being screwed alternately to the first and second flanges respectively, each of the first and second flanges having a recess across from a fastening point so as to permit the tilting movement.

3. A folding blade shaft as defined in claim 2, and further comprising an annular clamping element configured to mount the first and second flanges at an end of one of the drive shaft and the spindle.

4. A folding blade shaft as defined in claim 1, wherein the drive shaft has a face bore and the spindle has a journal, the radial rocker bearing including an outer ring arranged in the face bore of the drive shaft and an inner ring arranged on the journal of the spindle.

* * * * *